United States Patent [19]

Ku

[11] 4,079,824

[45] Mar. 21, 1978

[54] DOUBLE SPEED DOT MATRIX PRINTHEAD

[75] Inventor: Joseph Po-Wah Ku, Foster City, Calif.

[73] Assignee: Xerox Corporation, Stamford, Conn.

[21] Appl. No.: 754,652

[22] Filed: Dec. 27, 1976

[51] Int. Cl.[2] ..... B41J 3/04

[52] U.S. Cl. ..... 197/1 R; 101/93.05

[58] Field of Search ..... 197/1 R; 101/93.04, 101/93.05; 178/23, 30; 346/1, 139, 141

[56] References Cited

U.S. PATENT DOCUMENTS

| | | | |
|---|---|---|---|
| 3,757,346 | 9/1973 | Holland | 346/1 |
| 3,900,094 | 8/1975 | Larsen et al. | 197/1 R |
| 4,010,835 | 3/1977 | Martin et al. | 197/1 R |

*Primary Examiner*—Ralph T. Rader

*Attorney, Agent, or Firm*—Michael J. Colitz, Jr.; Terry J. Anderson; Barry Paul Smith

[57] ABSTRACT

A dot matrix printer including a single printhead having two columns of print wires, the wires in one column being used to print only odd numbered dot columns on a record member and the wires in the other column being used to print only even numbered dot columns on the record member. In one embodiment the wire columns are spaced apart a distance equal to an even number multiple of the space between two adjacent dot columns and the wires in each column are then energized alterntely as the printhead traverses the dot column positions. In another embodiment the wire columns are spaced apart an odd number multiple of the space between two adjacent dot columns and the wires in each column are then energized simultaneously as the printhead traverses the record member.

7 Claims, 7 Drawing Figures

FIG_1
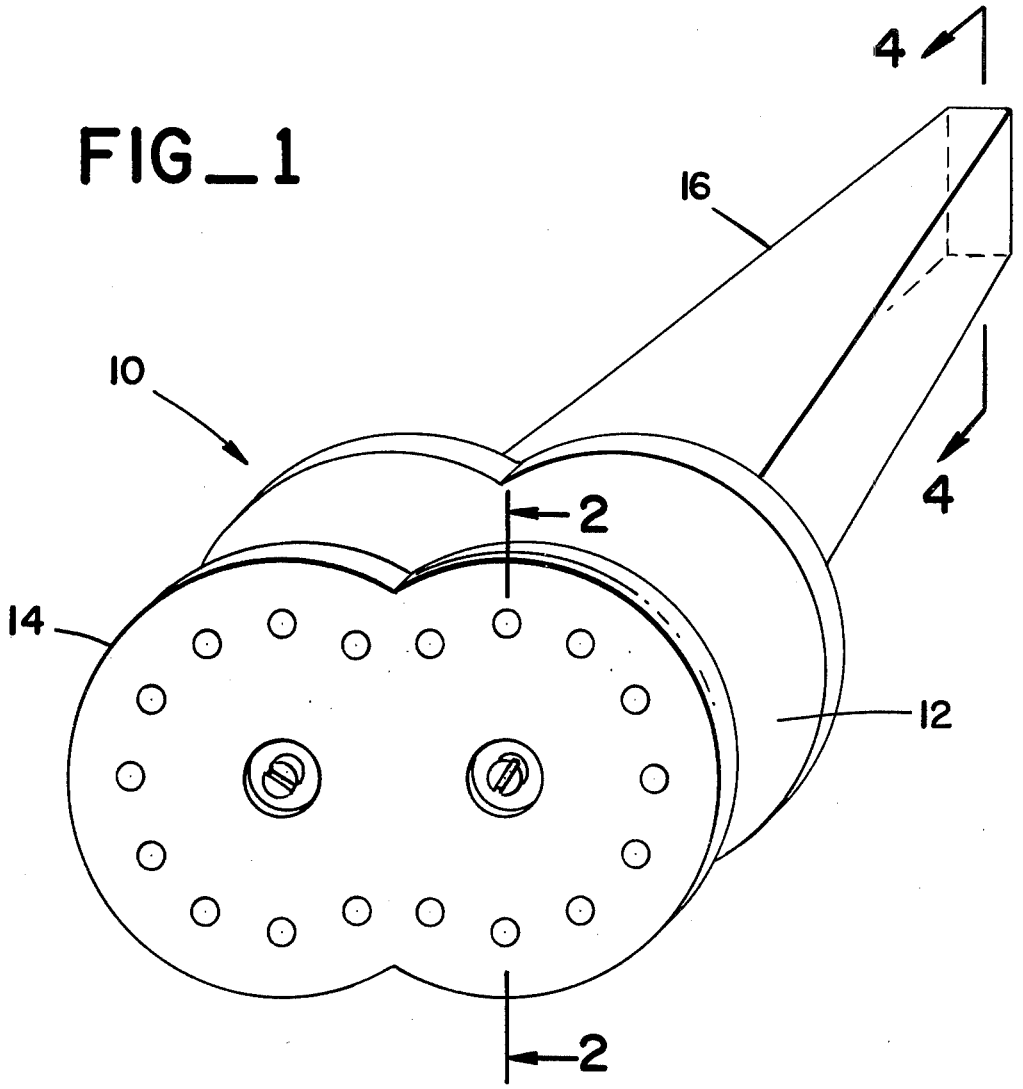
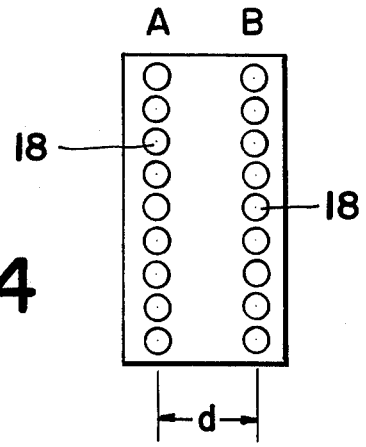
FIG_4
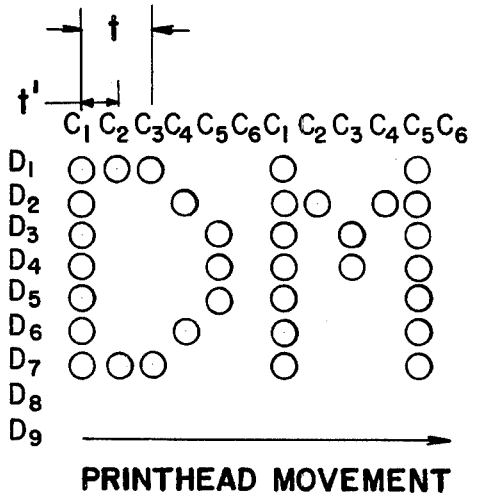
FIG_5

DOUBLE SPEED DOT MATRIX PRINTHEAD

BACKGROUND OF THE INVENTION

The present invention relates to an apparatus and method for printing a dot matrix of characters on a record member and, more particularly, to an apparatus and method for substantially increasing the speed of such printing without reduction in the quality of the printed characters.

In a printer for printing a dot matrix on a record member, print or output ends of wires are held in a printhead in a fixed array. The printhead is fixed to a carriage which typically moves within a limited range along a track to successive printing stations. At each printing station, a predetermined number of wires are actuated to strike the record member through an inking ribbon to form a portion of a dot matrix of a character on the member. To actuate the print wires, electrical signals are generated to energize a determined number of electromagnets which control hammers or "clappers" which propel the wires to move them towards the record member. Both the wires and their electromagnets are embodied in the printhead, known as a matrix printhead, which typically has a single column of, for example, seven or nine wires, facing the record member.

It is, of course, desirable to design a wire printing system which can form characters as quickly as possible. In the present state of the art, the frequency of impact of a wire on a record member is about 1,000 impacts per second, which produces about 200 characters per second. This operating speed is limited by the minimum interval allowable between successive impacts of each wire, with such minimum interval being limited for a number of reasons. First, a sufficiently efficient electromagnetic material is not presently available to move the clapper fast enough to propel its associated wire to cause an impact rate significantly higher than about 1,000 cycles per second. Second, even if such material were presently available, the dynamics of the wire and clapper would impose upon the design of the printhead severe constraints such as allowable settling time, material strengths and wear characteristics of the wire and clapper. Alternately, to generate a strong magnetic field without an efficient magnetic material would impose severe restrictions on the design of the drive circuit for the clapper, power consumption, reliability and the economics of the printing system.

One system for increasing the rate of character formation includes operating the printhead wires at the present limit of about 1,000 impacts per second, but which provides two separate printheads, each printing half a line, thereby doubling the rate of character formation. In such a system, the two printheads, each having a single column of wires and movable together, are operated simultaneously so that while one printhead is printing the first half of a line, the other printhead is printing the second half of the line. This two printhead system has a number of disadvantages as will now be described.

In many instances, a dot matrix printer may not be printing a full line on a record member such as a sheet of paper. In this case, in the two printhead system the left printhead, for example, will be performing more work than the right printhead, the percentage of more work depending on the percentage of a full line being printed. If only half a line is to be printed, the right printhead will move along the record member, but will not perform any printing. Consequently, it is not unlikely that the left printhead will wear out much faster than the right printhead, thereby requiring significant time and cost in providing a new printhead and readjusting the machine for this new head. Also the use of two separate printheads requires additional manufacturing cost for hardware and additional physical space on the dot matrix printer, thereby adding additional design constraints. Perhaps even more importantly, the throughput or character formation of this machine when printing, for example, half a line, is still only that of the single head machine described above.

Furthermore, with a two printhead printer, line buffering is necessary in order to print a full line. That is, data incoming to the dot matrix printer and representing a full line of characters must be stored in two separate half-line buffers before the printer can be activated to print such a line. This is because the data for the first part of the left half of the line must be sent to the left printhead when data for the first part of the right half of the line is sent to the right printhead since the two printheads must be activated simultaneously to print both halves of the line simultaneously. Also, the dot matrix printer having the two separate printheads is relatively more difficult to control when it is responding to character at a time key-board data entry. To key in a whole line of information, the left printhead moves right to record the left half of the line, then the two printheads are returned to their original left position, printhead selection is then switched to the right printhead, and then keyed in data will be printed on the right half of the line with the right printhead.

In addition, in a dot matrix printer, the gap between the ends of the printhead wires and the record member must be accurately adjusted to achieve suitable print density. That is, this gap must be adjusted so that the wires will strike the record member through the inking ribbon with appropriate force to place a pronounced dark dot on the member. When two separate printheads are used, their gaps should be precisely the same; otherwise, for example, the left printhead might print characters which are darker than those printed by the right printhead, resulting in an overall appearance which is not pleasing. Since these gaps may be, for example, as small as 0.014 inches with tolerances of only $\pm$ 0.001 inches, it is oftentimes difficult to match accurately the gap distances of both printheads.

Yet another disadvantage of the dot matrix printer having two printheads is that the width of the record member on which it can print is limited if advantage is to be taken of the increased rate of character formation which such printer can provide. If a sufficiently wide paper is not used, then, for example, only the left printhead will be useful while the right printhead will not be energized. Thus, again the rate of character formation of the two printhead machine will be reduced, for example, to that of a single printhead machine described above.

Furthermore, as indicated above, the two separate printheads must be operated simultaneously to print respectively one half of a line. This means that the wires in both printheads will be energized simultaneously, thereby increasing the peak power requirements of the machine.

SUMMARY OF THE INVENTION

It is an object of the present invention to provide a novel apparatus and method for printing characters on a record member.

It is another object of the present invention to provide an apparatus and method which overcome the above-mentioned disadvantages of a two printhead dot matrix printer.

It is yet another object of the present invention to provide a novel dot matrix printer and method of operating the same.

A still further object of the present invention is to increase significantly the operating speed of a dot matrix printer without reducing the quality of the printed matter produced by relatively low speed printers.

These and other objects of the invention are obtained with a single printhead having a predetermined number of print wires arranged in two spaced columns and energizers for the wires. Each column has, for example, nine wires, and the wires in a column are moved to impact only alternate dot columns on the record member. The wires in one column are energized to print only odd-numbered dot columns on the record member, while the wires in the other column are energized to print only even-numbered dot columns on the recording member. While the minimum interval between impacts of wires in a given printhead column is the same as in the present state of the art, for example 1,000/second, the two columns of wires reduces by one half the minimum required interval for printing two adjacent dot columns on the record member, thereby doubling the rate of character formation.

In one embodiment the columns of wires are spaced apart a distance equal to an even number multiple of the space between two adjacent dot columns on the record member, center-to-center. In this embodiment, the wires of the respective columns are energized alternately to print, respectively, odd and even dot columns on the record member. In an alternative embodiment, the two multi-wire columns are spaced apart a distance equal to an odd number multiple of the space between two adjacent dot columns, center-to-center. In this latter embodiment, the wires of the respective columns are energized simultaneously to print, respectively, odd and even dot columns on the record member.

BRIEF DESCRIPTION OF THE DRAWINGS

FIG. 1 is a perspective view of the single printhead of the present invention.

FIG. 4 is an end elevation showing print wires and taken along lines 4—4 of FIG. 1.

FIG. 5 illustrates dot columns on a record member.

DETAILED DESCRIPTION OF THE DRAWINGS

Figure 2:
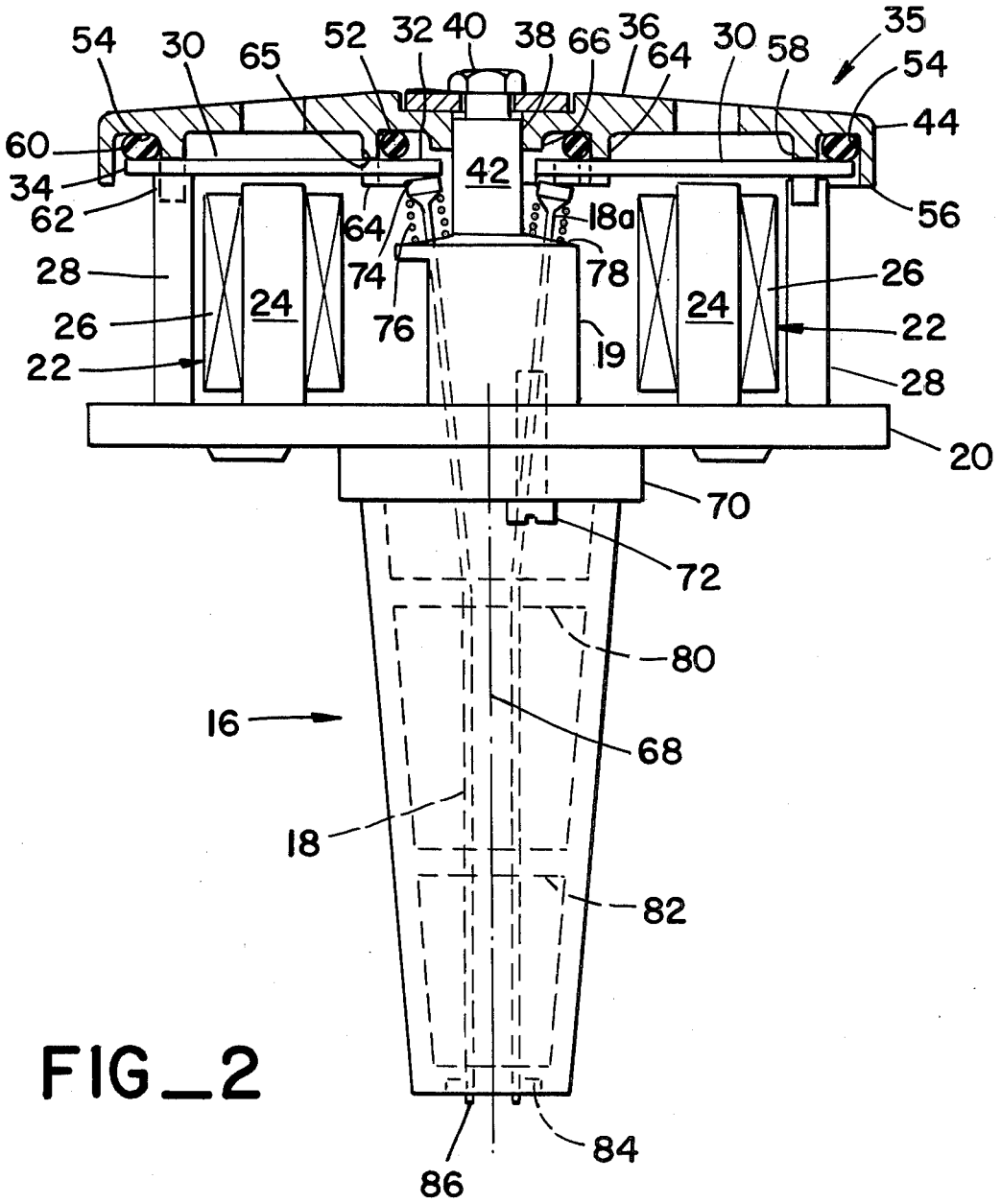
FIG. 2 is a cross-sectional view taken through lines 2—2 of FIG. 1.
Figure 7:
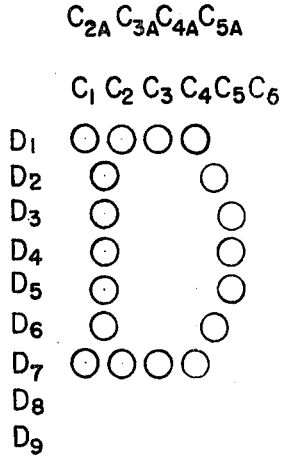
FIG. 7 is an alternative embodiment of dot columns on a record member.
Figure 3:
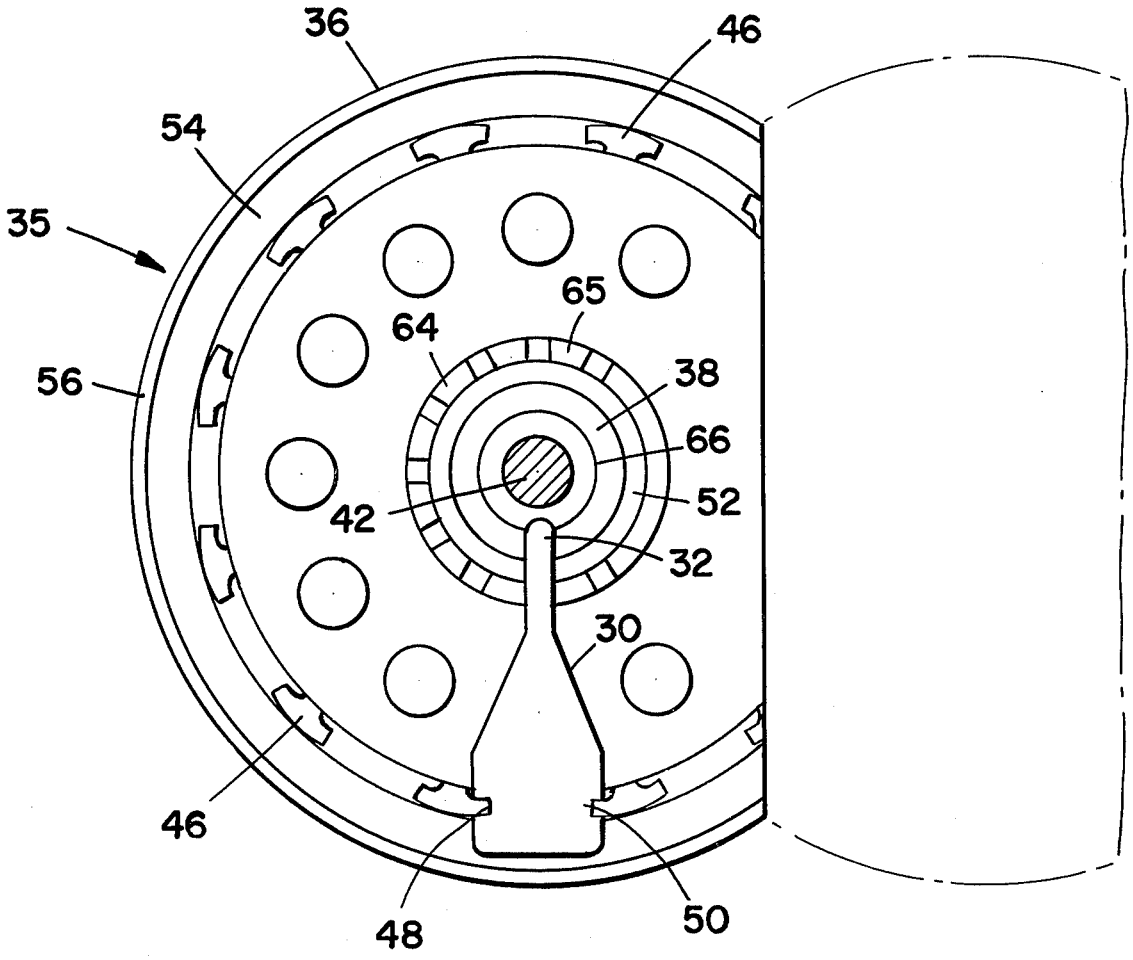
FIG. 3 is a bottom plan view of an armature retainer taken along lines 3—3 of FIG. 2 with one armature mounted therein.

With reference to FIGS. 1–3, there is shown a single printhead 10 comprising an odd side assembly 12 and an even side assembly 14, together with a common stylus guide assembly 16 for guiding a plurality of impact wires or styli 18 along predetermined paths. While FIGS. 2 and 3 include sections of assembly 12, it is to be noted that assembly 14 is the same as section 12 and, therefore, need not be separately shown in section.

Figure 6:
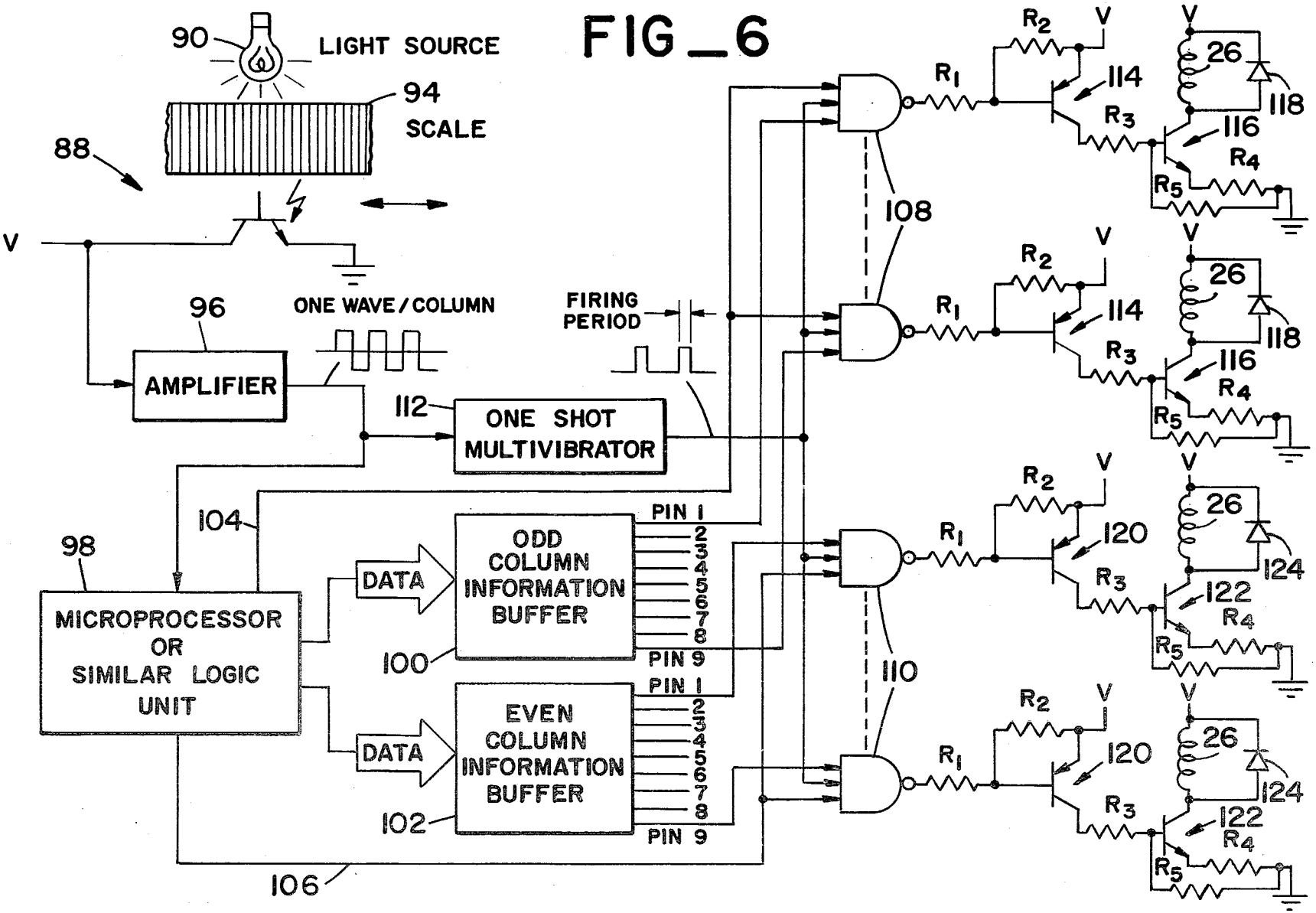
FIG. 6 is a schematic diagram of the electrical circuitry for energizing print wires in the printhead of FIG. 1.

Each assembly 12, 14 includes a support plate 20 having 9 electromagnets 22 supported on the support plate 20. Each electromagnet includes an inner pole piece 24 upstanding from the surface of the support plate 20 and a coil 26 disposed about the inner pole piece 22. Each coil 26 is electrically connected to a driver circuit (see FIG. 6) which selectively applies a predetermined current flow through the coil. Each electromagnet 22 also comprises an outer pole piece 28 upstanding from the top surface of the support plate 20 adjacent the associated coil 26.

Each assembly 12, 14 also comprises nine armatures or clappers 30 respectively associated with the nine electromagnets 22. Each clapper 30 forms with its associated electromagnet 22 an electromagnetic actuator for converting electrical energy into mechanical energy to move an associated one of the print wires 18. Each armature 30 has an inner end 32 and an outer end 34 extending outwardly from the outer pole piece 28 by a predetermined distance.

An armature retainer 35 for retaining each of the nine armatures 30 includes a relatively rigid disk 36 having a central opening 38 for receiving a screw 40 which is screwed into a cylindrical post 42 of the guide assembly 16 to connect the retainer 35 to the assembly 16. The disk 36 also includes a peripheral portion 44 having, as shown in FIG. 3, depending posts 46 for receiving a pair of notches 48, 50 of each clapper 30 for engagement by two adjacent posts 46, thereby restraining radial movement of the clapper 30 relative to the disk 36.

The retainer 34 also comprises a shock-absorbing member, such as an O-ring 52, together with a relatively resilient biasing member, such as a rubber O-ring 54, mounted to the peripheral portion 44 of the disk 36 between two adjacent circumferential walls 56, 58. The posts 46 are dependent from the wall 58.

As shown in FIG. 2, the cross-sectional diameter of the O-ring 54 is such as to compress normally when the retainer 35 is mounted to the guide assembly 16 with the electromagnet 22 de-energized. The diameter of the O-ring 54 and those of the walls 56, 58 are predetermined relative to the location of the clappers 30 and outer pole pieces 28. The axis 60 of the O-ring 54 is preferably slightly offset outwardly of the pivot line of each clapper 30, this pivot line being at the outermost edge 62 of the associated outer pole piece 28.

The retainer 35 has the primary function of retaining the clappers 30 engaged with their associated outer pole pieces 28. Additionally, and preferably, the retainer 35 also functions to apply a moment of force to each clapper 30 tending to cause the inner end 32 to rotate about the associated outer pole piece 28 to hold normally this inner edge in engagement with the O-ring 52.

As shown in FIG. 2, the disk 36 also includes a pair of walls 64, 66 depending from a central portion of the disk 36 and mounting the O-ring 52 therebetween. The wall 64 has nine spaced grooves 65 formed therein for accommodating respectively the clappers 30 at locations adjacent the inner ends 32. The grooves 65, in cooperation with the posts 46 and notches 48, 50 in each clapper suitably restrain any movement of the clappers in a the rod 36 and the periphery of the second piston 42. This spring is under initial compression and urges the piston 42 against the piston 8.

In operation when an impact is applied to the bumper 38, the rod 36 is caused to slide with the piston 8 in the liner 2 and the fluid in the head of the cylinder to the right of FIG. 3 flows through the slot 13 into the passage 39 and from there through the passage 40*a* and the apertures 41 into the passage 47 round the second piston thus urging the second piston to the left in FIG. 3 compressing the spring 12 while sliding on the guide member 45. Should the impact be such that the time the second piston is clear of the tapered end 46 of the guide member 45, the piston rod 36 will continue to travel to the right in FIG. 3 and the fluid passing through the aperture 41 into the space 47 will continue to force the piston 42 to the left in FIG. 1 compressing the spring 12. The shock absorber is calibrated including using a cylinder, a liner and a liquid or liquid and a gas as described above so as to absorb a shock of a given magnitude on the member 38 before the piston 8 engages the end cap 34 of the cylinder. If during this operation the piston 42 does clear the end 46 of the guide member 45, the fluid in the rod 36 round the rod 45 will pass through the bore 49 in the valve block 50 in the rod 36 and into the space within the rod to the left of the block 50 in FIG. 3 and any excess can pass out of the vent apertures 48 at the end of the rod 36.

As soon as the impact has been absorbed and the pressure is taken off and the cylinder and liner have returned to their initial conditions the member 38, the spring 12 will reassert itself or these effects may occur simultaneously forcing the piston 42 back into its rest position shown in FIG. 3 and the fluid will be forced by the returning piston in the reverse direction into the head of the main cylinder 1.

In FIG. 3 the slot 13 and the fluid used within the cylinder and rod will be as described with reference to FIGS. 1 and 2.

It will be seen that by the constructions described a great control of the impact is possible with shock absorbers in accordance with this invention. The cylinder construction allows for a controlled expansion and hence variation of the area of the liquid flow path past the piston in both directions of movement of the piston in the cylinder so that the liquid flow rate through said path may be automatically varied and hence providing a shock absorber capable of offering varying resistance to a wide range of shock valves.

I claim:

1. A shock absorber comprising a cylinder closed at one end and resiliently deformable radially outwards at a predetermined internal pressure, a resilient liner within said cylinder in intimate contact with the wall of said cylinder, a fluid-tight seal at the open end of said cylinder, a piston rod extending through said seal, a piston in said cylinder and connected to said rod and in sliding engagement with the inner wall of said liner, impact receiving means on the free end of said rod outside said cylinder; a liquid of predetermined flow characteristics in said cylinder, and at least one zone extending over a substantial length of the stroke of said piston and having a cross section varying over at least part of the length to form a single free liquid flow path past said piston, the configuration of said zone, said flow characteristics of said liquid, the pressure in the closed end of said cylinder and the resilience of the material of at least one of said cylinder and said liner resulting in shocks being absorbed by the shock absorber in accordance with predetermined characteristics.

2. A shock absorber according to claim 1 wherein said liquid partly fills said cylinder, the remainder of the cylinder containing gas and said liquid with said gas in said cylinder forms an emulsion when the shock absorber is subjected to shock.

3. A shock absorber according to claim 1 wherein the flow of said liquid in operation to absorb a shock will be controlled to within an acceleration and deceleration rate characteristic of 39g.

4. A shock absorber according to claim 1 wherein resilient means are disposed to react on said cylinder and said piston to return said piston to an at rest position in said cylinder after displacement.

5. A shock absorber according to claim 1 wherein said piston rod is hollow, a second piston is slidingly disposed in said hollow piston rod, a liquid flow path is provided past said first named piston to a space in said rod on the high pressure side of said second piston, a guide member is disposed fast at one end with said first named piston and disposed to close a valve mounted in said hollow rod, said second piston is slidably disposed with respect to said guide member, a vent is provided in the end of said piston rod remote from said pistons through which excess liquid can escape, said guide member on said second piston being shorter than said hollow piston rod interior such that after initial displacement of said second piston by a force on the shock absorber said guide member opens a valve in said rod leaving a bore through which said liquid can pass to said vent.

* * * * *